US009330584B2

(12) United States Patent
Pietro et al.

(10) Patent No.: US 9,330,584 B2
(45) Date of Patent: May 3, 2016

(54) METHOD AND SYSTEM FOR DEVELOPING AN ELECTROLUMINESCENT SIGN

(75) Inventors: William Joseph Pietro, Toronto (CA); Scott Stephen Fielder, Toronto (CA)

(73) Assignee: Scobil Industries Corp., Toronto, Ontario (CA)

( * ) Notice: Subject to any disclaimer, the term of this patent is extended or adjusted under 35 U.S.C. 154(b) by 1350 days.

(21) Appl. No.: 12/193,515

(22) Filed: Aug. 18, 2008

(65) Prior Publication Data

US 2010/0037497 A1 Feb. 18, 2010

(51) Int. Cl.
*G09F 13/22* (2006.01)
*G09F 13/00* (2006.01)

(52) U.S. Cl.
CPC ..... *G09F 13/22* (2013.01); *G09F 13/005* (2013.01); *G09F 2013/225* (2013.01)

(58) Field of Classification Search
CPC ..... G09G 3/32; G09G 13/22
USPC ..... 345/76; 315/86; 313/493, 509, 510, 313/512, 506
See application file for complete search history.

(56) References Cited

U.S. PATENT DOCUMENTS 5,066,893 A 11/1991 Osada et al.
5,359,341 A 10/1994 Hutchings
5,686,797 A 11/1997 Sanderson
5,717,317 A 2/1998 Pleso
5,854,474 A * 12/1998 Goodwin, III ..... 235/383
6,771,256 B1 8/2004 Abraham et al.
6,876,357 B2 4/2005 Kim
7,220,930 B2 5/2007 Gordon et al.

(Continued)

FOREIGN PATENT DOCUMENTS

JP 2001-000631 5/2007
WO 0195300 A1 12/2001

(Continued)

OTHER PUBLICATIONS

International Search Report and the Written Opinion of the International Searching Authority received on the corresponding international Application No. PCT/CA2009/001101, dated Nov. 9, 2009.

(Continued)

*Primary Examiner* — Olga Merkoulova
(74) *Attorney, Agent, or Firm* — Philip C. Mendes da Costa; Bereskin & Parr LLP/ S.E.N.C.R.L., s.r.l.

(57) ABSTRACT

The described embodiments relate to methods and systems for developing an electroluminescent sign. In particular, described embodiments relate to methods and systems that process an image file to generate data for use in developing the electroluminescent sign. Further embodiments relate to an electroluminescent sign developed and/or produced in accordance with the described methods and/or systems. Certain embodiments relate to a method of developing an electroluminescent sign based on an image file. The method comprises processing the image file to generate image data representing at least one illuminating image layer and electrical configuration data, transferring the at least one illuminating image layer onto a substrate and configuring a luminescence controller of the electroluminescent sign based on the electrical configuration data. The configured luminescence controller cooperates with the substrate to provide a luminescent image based on the image file.

24 Claims, 10 Drawing Sheets

(56) References Cited

U.S. PATENT DOCUMENTS

| | | | | |
|---|---|---|---|---|
| 7,781,023 | B2 * | 8/2010 | Aldarondo et al. | 427/407.1 |
| 2001/0018809 | A1 * | 9/2001 | Heropoulos et al. | 40/544 |
| 2003/0214471 | A1 * | 11/2003 | Topelberg | 345/87 |
| 2005/0078104 | A1 * | 4/2005 | Matthies et al. | 345/204 |
| 2005/0091890 | A1 | 5/2005 | Snyder | |
| 2007/0029939 | A1 * | 2/2007 | Burkum et al. | 315/86 |
| 2007/0082123 | A1 * | 4/2007 | Aldarondo et al. | 427/64 |
| 2007/0113440 | A1 * | 5/2007 | Asvadi | 40/544 |
| 2008/0155869 | A1 * | 7/2008 | Golle et al. | 40/544 |

FOREIGN PATENT DOCUMENTS

| | | | |
|---|---|---|---|
| WO | 2005006286 | A1 | 1/2005 |
| WO | 2007/018996 | A1 | 2/2007 |
| WO | 2007021362 | | 2/2007 |
| WO | 2008/070098 | A2 | 6/2008 |

OTHER PUBLICATIONS

European Search Report dated Mar. 24, 2014, issued on EP Application No. 09807777.9.

* cited by examiner

METHOD AND SYSTEM FOR DEVELOPING AN ELECTROLUMINESCENT SIGN

TECHNICAL FIELD

The described embodiments relate to methods and systems for developing an electroluminescent sign. In particular, the described embodiments relate to methods and systems that process an image file to generate data for use in developing an electroluminescent sign. The described embodiments also relate to methods and systems to control an electroluminescent sign.

BACKGROUND

Illuminated signage can be a popular way of marketing or advertising. Traditionally, illuminated signage may employ fluorescent lighting or other forms of light emitting bulbs or tubes as a light source.

More recently, it has become possible to generate light from a flat luminescent substrate in response to electrical stimulation of the substrate. This effect can be used to create an electroluminescent sign. However, the creation of such electroluminescent signs involves substantial electrical complexity and professional effort to design the electrical components and circuitry to meet the requirements of each different electroluminescent sign.

SUMMARY

The voltage required to illuminate a section of electroluminescent material is based on at least one of the size of the section, the colour of the electroluminescent material and the intensity of the illumination that is desired. The power to control the magnitude of the light in based on a complex relationship between voltage, frequency and duty-cycle. For example, the larger the area of the section, the greater the amount of voltage that is required to obtain the same degree of illumination of that section (e.g., the same candles per square inch). In accordance with some embodiments of this invention, a sign has a plurality of sections of electroluminescent material that may be illuminated (illuminating sections). In one such embodiment, the amount of electrical energy directed to an illuminating section is determined concurrently with the creation of image data that represents that illuminating section. This amount of electrical energy comprises electrical configuration data that may be programmed into a controller.

In accordance with this embodiment, methods and systems for developing an electroluminescent sign are provided. In particular, described embodiments relate to methods and systems that process an image file to generate data for use in developing the electroluminescent sign. Further embodiments relate to an electroluminescent sign developed and/or produced in accordance with the described methods and/or systems.

Certain embodiments relate to a method of developing an electroluminescent sign based on an image file. The method comprises electronically processing the image file to generate image data representing at least one illuminating image layer, which has at least one and may have a plurality of illuminating sections, and electrical configuration data; producing the at least one illuminating image layer on a substrate of the electroluminescent sign from the image data; and, configuring a luminescence controller of the electroluminescent sign based on the electrical configuration data, wherein, in use, the configured luminescence controller transmits electrical energy to the at least one illuminating image layer.

In some embodiments, the image file represents an image, and electronically processing the image file to generate image data comprises dividing the image into a plurality of illuminating sections which are to be provided in at least one illuminating image layer; and, generating illuminating image data representing each illuminating section.

Preferably electronically processing the image file to generate image data further comprises, also dividing the image into at least one non-illuminating section and generating non-illuminating image data representing the at least one non-illuminating section of the image.

Alternately, or in addition, electronically processing the image file to generate image data further comprises producing the at least one non-illuminating section of the image on the substrate, preferably through lamination, using the non-illuminating image data.

Alternately, or in addition, the at least one illuminating image layer has at least one illuminating section and the method further comprises providing a non-illuminating image on the substrate and aligning the at least one illuminating section with a corresponding portion of the non-illuminating image.

In any of these embodiments, the method may further comprise dividing the image into a plurality of illuminating sections and wherein electronically processing the image file to generate electrical configuration data comprises producing voltage data corresponding a degree of illumination for the illuminating sections.

In any of these embodiments, the at least one illuminating image layer has at least one illuminating section and electronically processing the image file to generate electrical configuration data may comprise selecting an illumination time period; dividing the illumination period into a plurality of time segments; assigning an illumination intensity value to each of the plurality of time segments; and, generating timing data for configuring timing of luminescence of one or more illuminating sections of the at least one image layer using the illumination intensity values. In such a case, electronically processing the image file to generate electrical configuration data may further comprise generating a sequence of commands using the timing data, wherein the sequence of commands controls the electrical energy transmitted to at least one of the illuminating sections. Preferably, the sequence of commands include voltages values represents voltages transmitted to at least one of the illuminating sections. Preferably the voltage values are generated based on the timing configuration data and dimensions of the at least one illuminating section.

In any of these embodiments, the at least one illuminating image layer may comprise a plurality of illuminating sections, and the electrical configuration data may comprise timing data for configuring timing of luminescence of one or more of the illuminating sections.

In any of these embodiments, the at least one illuminating image layer may comprise a plurality of illuminating sections, and the electrical configuration data comprises timing data for configuring timing of luminescence of the plurality of illuminating sections.

In any of these embodiments, producing the at least one illuminating image layer on the substrate may include using a screening process.

In any of these embodiments, the method may further comprise generating at least one screen for the at least one illuminating image layer using the image data. Preferably producing the at least one illuminating image layer on the substrate includes applying at least one ink layer to the substrate using the at least one screen.

In any of these embodiments, the luminescence controller is programmable and the method further comprises inputting the electrical configuration data into the luminescence controller.

In accordance with another aspect of this invention, there is provided a system for developing an electroluminescent sign, comprising at least one processor; and data storage accessible to the at least one processor and storing program instructions which, when executed by the at least one processor, cause the at least one processor to process an image file to generate image data that represents at least one illuminating image layer and electrical configuration data, wherein the image data is for producing the at least one illuminating image layer on a substrate of the electroluminescent sign and wherein the electrical configuration data is for configuring a luminescence controller of the electroluminescent sign wherein, in use, the configured luminescence controller transmits electrical energy to the at least one illuminating image layer.

In such an embodiment, the electrical configuration data may comprise timing data for configuring timing of luminescence of one or more illuminating sections of the at least one illuminating image layer.

Alternately, or in addition, the electroluminescent sign may comprise a plurality of illuminating sections and the electrical configuration data comprises voltage data corresponding a degree of illumination for the illuminating sections.

In accordance with another aspect of this invention, there is provided an electroluminescent sign produced by the process comprising receiving an image file; processing the image file to generate image data representing at least one illuminating image layer, and electrical configuration data; producing the at least one illuminating image layer on a substrate of the electroluminescent sign using the image data; and, configuring a luminescence controller of the electroluminescent sign based on the electrical configuration data, wherein, in use, the configured luminescence controller transmits electrical energy to the at least one illuminating image layer.

In accordance with another aspect of this invention, an electroluminescent sign may be mountable, such as in a frame. The frame or mount for the sign preferably has incorporated or associated therewith a controller. The controller may be programmable or replacable, and is preferably programmable, such that it may control the illumination (e.g., intensity, duration and/or sequence) of at least some, and preferably all, of the illuminating sections of the sign. Accordingly, the sign may be provided with a plurality of ports that are connectable, preferably removably connectable, with mating ports of the controller. Accordingly, a new sign may be installed at a location by mounting the sign on an existing mount or placing it in or on an existing frame and plugging the controller into the sign. The controller may be replaced with a new controller programmed for the new sign or the controller may be programmed for the new sign, such as by downloading a new program into the controller.

The controller may be programmed with different electrical configuration data appropriate for the new sign. For example, the number of sections of the sign may be different (larger or smaller) then the previous sign. Accordingly, the electrical configuration data may contain data for a larger or smaller number of illuminating sections. Alternately, or in addition, the size of some or all of the illuminating sections may be sufficiently different to require a differing amount of voltage to achieve a desired level of illumination. Alternately, it may merely be desired to adjust the sequence, intensity, etc. of illumination of an existing sign. Accordingly, the controller may be reprogrammed, such as by any means known in the art, so that the controller is configured to control the new sign.

Alternately, or in addition, the level of intensity, duration of illumination of and/or sequence of illumination of some or all of the illuminating sections of a sign may be altered by reprogramming the controller.

In accordance with this aspect of the invention, there is provided an electroluminescent sign comprising:

(a) a plurality of illuminating sections configured to be individually illuminated; and, (b) a controller selectively operably connected to at least some of the, and preferably each, illuminating section, the controller being programmable with electrical configuration data corresponding to at least one of a degree of illumination for at least some of the, and preferably each, illuminating section, a sequence of illumination for at least some of the, and preferably each, illuminating section and the timing of illumination for at least some of the, and preferably each, illuminating section.

In one embodiment, the controller is removably coupled to the electroluminescent sign. Preferably, the electroluminescent sign has a plurality of electrical ports, each port being electrically connected to at least one illuminating section and the controller has a plurality of electrical ports removably coupled to the electrical ports of the electroluminescent sign, wherein the controller has at least as many electrical ports as the electroluminescent sign.

It will be appreciated that different signs may have different numbers of illuminating sections. Therefore, the controller preferably has at least as many electrical ports as a sign is expected to have. Accordingly, in some embodiments, the electroluminescent sign has fewer electrical ports then the controller.

Further embodiments relate to computer readable storage having store therein in computer program instructions which, when executed by at least one processor, cause the at least one processor to perform any of the methods described above.

Still further embodiments relate to an electroluminescent sign developed or produced by any of the methods and systems described above.

BRIEF DESCRIPTION OF THE DRAWINGS

The embodiments are described hereinafter in greater detail, and by way of example only, with reference to the accompanying drawings, in which.

DETAILED DESCRIPTION

The described embodiments relate to methods and systems for developing an electroluminescent sign. In particular, described embodiments relate to methods and systems that process an image file to generate data for use in developing the electroluminescent sign. Further embodiments relate to an electroluminescent sign that may be developed and/or produced in accordance with the described methods and systems and/or a controller for operating a sign.

Figure 1:
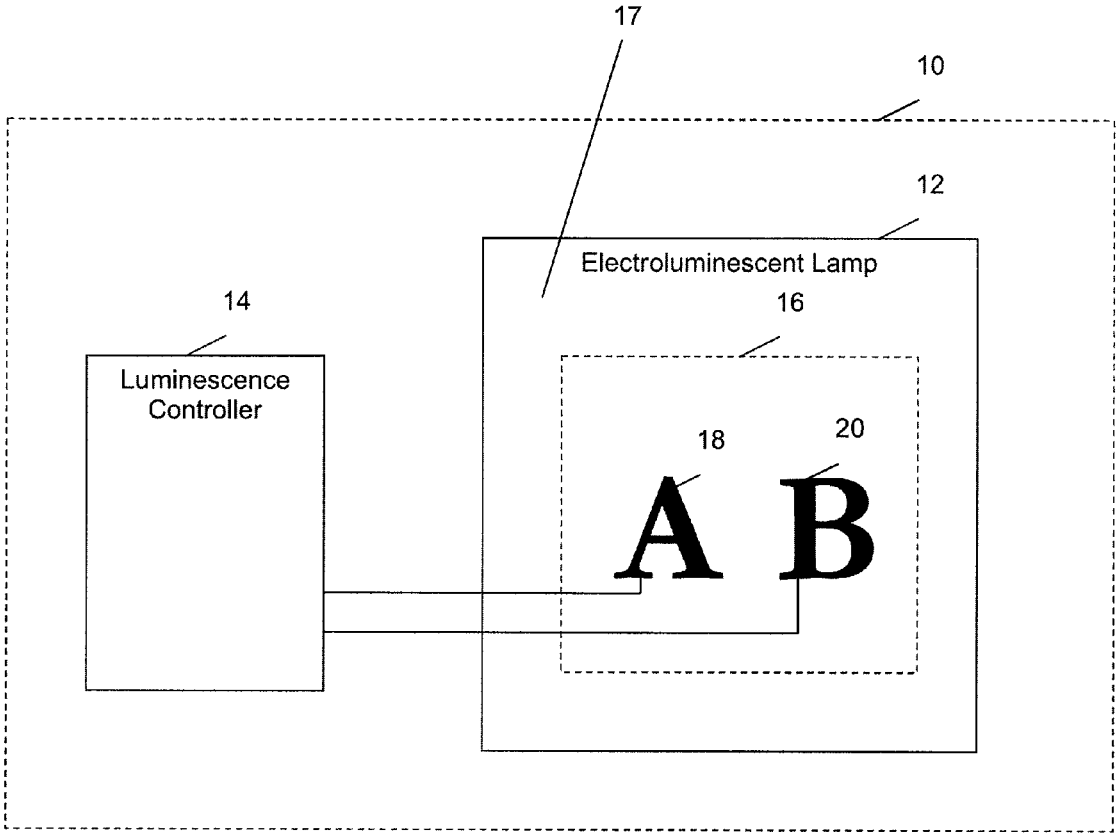
FIG. 1 is a bock diagram of an electroluminescent sign.

A block diagram of an electroluminescent sign 10 is exemplified in FIG. 1. The electroluminescent sign 10 comprises a substrate with an illuminatable image, that may be referred to as electroluminescent lamp 12, electrically coupled or attached, preferably removably coupled or attached, to a luminescence controller 14. The luminescence controller 14 applies voltage to the electroluminescent lamp 12 to illuminate an image 16 formed on the electroluminescent lamp 12. Luminescence controller 14 may be any controller capable of receiving and storing the instructions for operating the lamp 12 and providing the commands to the lamp 12. Accordingly luminescence controller 14 comprises a processor, preferably programmable, and data storage. Any processor and data storage mechanism known in the arts may be used.

As exemplified in FIG. 1, the image 16 is shown as comprising the letters "A" and "B". The image 16 may be divided into a number of illuminating sections 18, 20 on one or more illuminating image layers 34, that are individually coupled to the luminescence controller 14, and are preferably selectively controlled by luminescence controller 14. An illuminating section is a part of the lamp that is electrically isolated from other illuminating sections of lamp 12 so that it may be individually illuminated. Accordingly, luminescence controller 14 may individually control, e.g., the time, duration and/or intensity of illumination of each illuminating section. In FIG. 1 the first illuminating section 18 comprises the letter "A" and the second illuminating section 20 comprises the letter "B". This configuration allows the luminescence controller 14 to separately control/illuminate the illuminating sections 18, 20. Accordingly, luminescence controller 14 may provided provide differing amounts of voltage to sections 18, 20 and/or may illuminate sections 18 and 20 for differing amounts of time and/or may illuminate them sequentially or in any pattern, thereby causing one or more of them to, e.g., flash. It will be appreciated that letters "A" and "B" may each comprise a plurality of illuminating sections. Alternately or in addition, background 17 on which letters "A" and "B" are provided may be non-illuminating or may comprise one or more illuminating sections. Accordingly, a sign may comprise any desired number of illuminating sections and, optionally, one or more non-illuminating section. A non-illuminating section is a part of lamp 12 that is not illuminated and may have an image printed thereon.

The voltage required to illuminate each illuminating section to a particular degree of illumination is dependent on the size of the illuminating section and the colour of the electroluminescent material. The brightness may be increased by applying more voltage, but at some point it may reach a saturation point. The average brightness is roughly proportional to the frequency up to at least 5 kHz, and also depends on the waveform of the applied voltage.

The luminescence controller 14 may comprise a memory or other similar storage device that stores electrical configuration data, e.g., a command or a sequence of commands to control the illumination of the electroluminescent lamp 12 and a processor to issue the command or commands. The sequence of commands may include which of the illuminating sections to illuminate when, for how long, and/or at what brightness. For example, say, as exemplified, that image 16 comprises two illuminating sections 18, 20 as shown in FIG. 1. The sequence of commands may include the following instructions: (a) illuminate section "A" for 5 seconds, (b) illuminate section "B" for 10 seconds, (c) illuminate sections "A" and "B" for 3 seconds, and (d) repeat. In one embodiment the sequence of commands may comprise a series of voltage settings. The memory or other similar storage device may be configurable (e.g., reprogrammable or replacable) so that the sequence of commands may be updated or modified at a later date.

Figure 2:
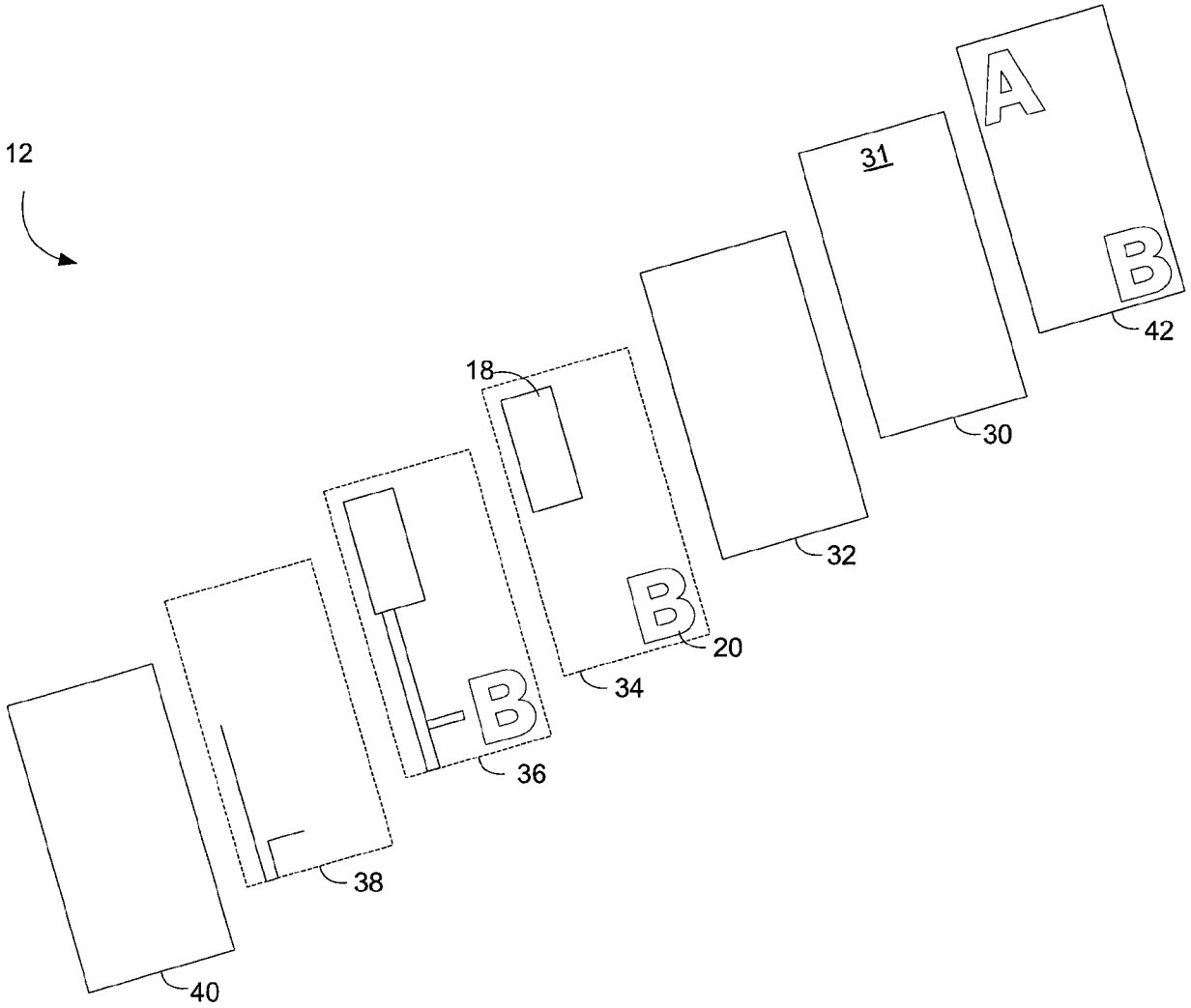
FIG. 2 is an exploded view of an electroluminescent lamp.

The exploded view of an electroluminescent lamp 12 is exemplified in FIG. 2. The electroluminescent lamp 12 is comprised of a substrate 30 and a number of layers 32, 34, 36, 38 formed thereon. The layers may be formed on the substrate 30 through any known process such as extrusion through a slot die, or by screen-printing. In the embodiment exemplified in FIG. 1, the electroluminescent lamp 12 is comprised of a front electrode layer 32, an electroluminescent or illuminating image layer 34, a dielectric layer 36, a rear electrode layer 38 and preferably an encapsulation layer 40. When a voltage is applied across the front and rear electrode layers 32 and 38, the electroluminescent layer 34 is activated and emits light.

The substrate 30 acts as the base of the electroluminescent lamp 12 and may be comprised of any suitable transparent or translucent material such as glass or plastic. The substrate 30 may be rigid or flexible (e.g., 2-5 mil thick). The substrate provides the support for the remaining layers. Substrate 30 has an outer face 31 which is the outer face exposed to a viewer. A non-illuminating image layer 42 may be printed directly on substrate 30 and/or may be mounted on substrate 30, such as being laminated thereto. Accordingly, in one embodiment, layers 30 and 42 may comprise a single element, e.g., a standard plastic sheet on which a non-illuminating image is printed. The non-illuminating layer has at least one section that is design or intended to be illuminated by illuminating image layer 34.

Preferably, the next layer is the front electrode layer 32. The front electrode layer 32 is comprised of suitable optically transparent and electrically conductive material such as indium-tin-oxide (ITO). This layer may be a thin coating applied to the inner face (the face opposite to outer face 31, of substrate 30.

The electroluminescent or illuminating image layer 34 is formed on the rear face of the front electrode layer 32 and forms the image to be illuminated (e.g. illuminating sections 18, 20). The electroluminescent layer 34 may be made of any suitable phosphor such as copper, activated zinc sulfide, or manganese activated zinc sulfide.

Where the image 16 is divided into different illuminating sections (i.e. 18, 20), each of the layers 32, 34, 36, 38 of the electroluminescent lamp 12 may be formed in the shape of the illuminating sections provided the electrode layers 32, 38 are electrically isolated from each other. For example, in FIG. 1 the image 16 is divided into two illuminating sections 18, 20, the "A" on substrate 30 being illuminated by illuminating section 18 and the "B" on substrate 30 being illuminated by illuminating section 20. In this case, there are two portions that are formed on front electrode layer 32. One portion is exemplified as being formed in the shape of a rectangle that, when the sign is assembled, is positioned such that the "A" on layer 42 is positioned on top of illuminating section 18. The other portion is exemplified as being be formed in the shape of the "B" of layer 42 and positioned such that the "B" on layer 42 is positioned on top of illuminating section 20. These illuminating sections would be mounted, e.g., printed, on the rear face of front electrode layer 32. The layers would be spaced apart as shown in FIG. 1 such that illumination of section 18 would not cause illumination of section 20 (i.e. they are electrically isolated from each other). It will be appreciated that sections 18, 20 may abut, in which case an insulation layer is preferably provided between adjacent surfaces if the sections are sufficiently close such that electricity may, e.g., arc from one to the other. It will be appreciated that, if the entire image 16 is to be illuminated, the layer may extend over the entire layer 32, as represented by the dotted line of illuminating image layer 34.

Where the image 16 contains a plurality of colors, the image 16 may be divided into a number of illuminating sections 18, 20, wherein, for example, each illuminating sections represents a separate color. Each of these image layers may be separately applied to the rear surface of front electrode layer 32 such as by printing using a plurality of masks or screens.

After the electroluminescent of illuminating image layer 34 preferably is the dielectric or insulating layer 36. The dielectric layer 36 may be comprised of electrically insulating material that provides a barrier to the flow of electricity. Suitable insulating material includes conventional dielectric powders, such as white dielectric powder, in a suitable binder. The insulating layer may be applied over the entire rear surface of electrode layer 32, such that it overlies the illuminating sections and the front electrode as represented by the dotted outline of insulating layer 36. Alternately, it may be applied over only the illuminating sections and the portion of front electrode 32 on which the rear electrode 38 will be provided.

The rear electrode layer 38 is preferably formed on the dielectric layer 36 and may be comprised of any suitable electrically conductive material. The rear electrode layer 38 may be comprised of the same material as the front electrode layer 32, such as ITO, or a different material. For example, the rear electrode layer 36 may be comprised of a suitable opaque material such as a silver, gold or graphite-based material.

In other embodiments the electroluminescent lamp 12 comprises additional layers. For example, the electroluminescent lamp 12 may further comprise an encapsulation layer 40 that acts as a water barrier to protect the electroluminescent layer 34 from atmospheric moisture.

It will be appreciated that electroluminescent lamp 12 may be of various other constructions and that various aspects of this invention may be used with any such construction.

Figure 3:
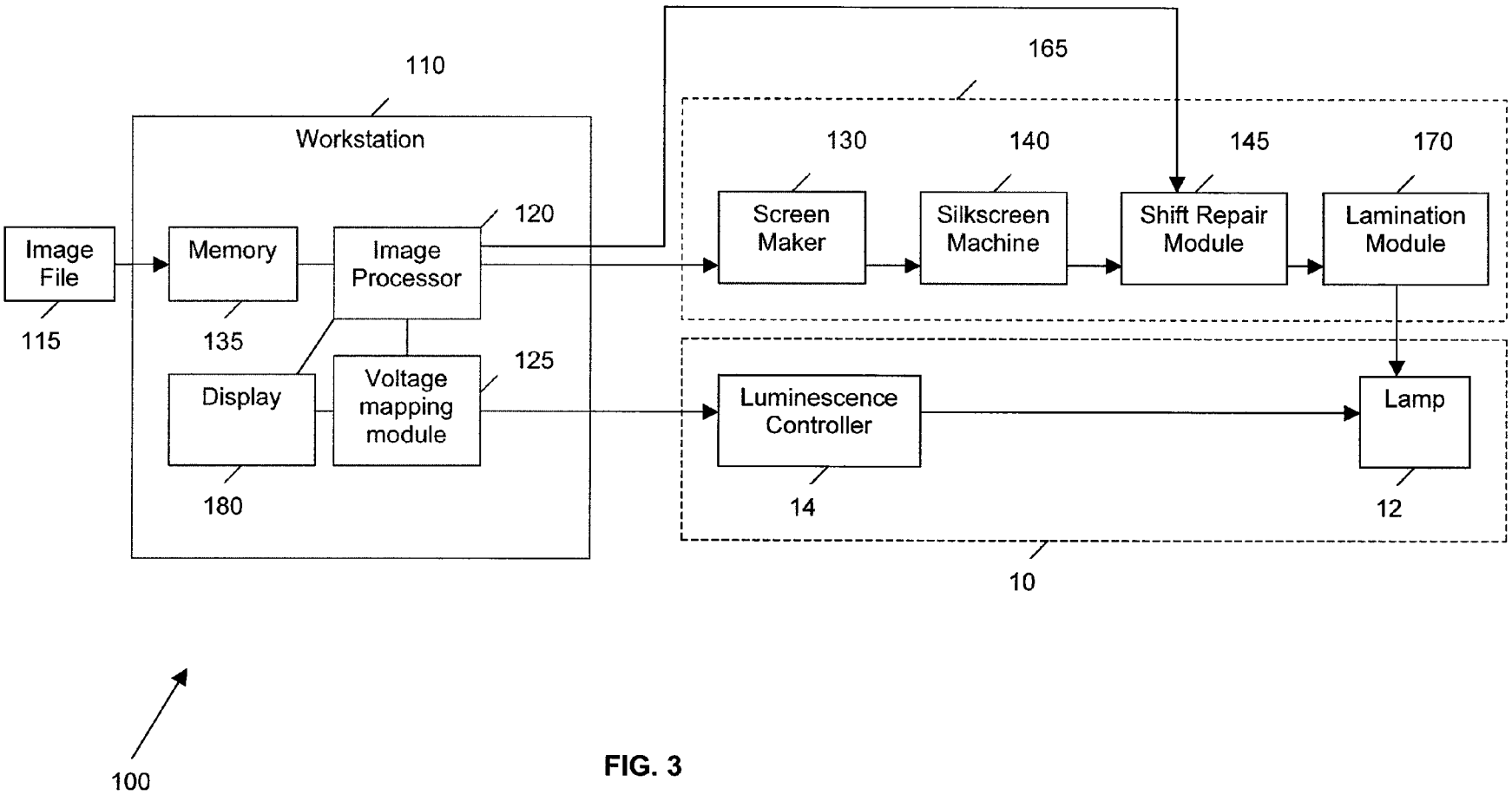
FIG. 3 is a block diagram of a system for developing an electroluminescent sign.

Reference is now made to FIG. 3, in which a block diagram of a system 100 for developing an electroluminescent sign 10 is exemplified. The system 100 includes an image file 115, a workstation 110 and an electroluminescent lamp generator 165, which co-operate to develop an electroluminescent sign 10.

The image file 115 may be a vector-based graphics file that represents the image to be displayed on the electroluminescent sign 10. In a vector-based graphics file the image is defined by mathematical descriptions, as opposed to individual pixels. Suitable vector-based graphics file formats include, but are not limited to, EPS (Encapsulated PostScript), PDF (Portable Document Format), WMF (Windows Metafile), SVG (Scalable Vector Graphics) and VML (Vector Markup Language). The image file 115 may be generated by an artist using a vector-based graphics editor and then loaded into the workstation 110. It will be appreciated that the image file may be obtained from any source, e.g., an existing commercial advertisement, that may be a picture that is scanned to produce a data file or obtained as a data file.

As exemplified, the workstation 110 includes a memory 135, an image processor 120, a voltage mapping module 125 and a display 180. The memory 135 stores the image file 115 and may comprise volatile (e.g. random access memory (RAM)) and/or non-volatile memory (e.g. read only memory (ROM)).

The image processor 120 is coupled to the memory 135 and the display 180, and is configured to retrieve the image file 115 and divide the corresponding image into an illuminating image layer and a non-illuminating image layer or a plurality of image layers optionally with one or more non-illuminating layers. The non-illuminating image layer(s) is obtained as non-illuminating image data, which may subsequently be used to print the non-illuminating image layer, with or without any distortion. Typically an operator will input which sections of the image are to be illuminated and which are not to be illuminated. The processor will then divide the image into illuminating and non-illuminating layers based in the input received from the operator. The sections of the image that will not be illuminated will typically form the non-illuminating image layer, although other non-illuminating layers may be provided separately. The sections of the image that will be illuminated may be further subdivided into a plurality of illuminating image layers, each of which contains one or more illuminating sections. Each illuminating image layer may represent a different color used in the image. For example, as exemplified in FIG. 1 there are two illuminating sections 18, 20, and the first illuminating section 18 (i.e. the "A") is to be blue and the second illuminating section 20 (i.e. the "B") is to be red. One illuminating image layer may contain all aspects of the illuminating sections that are blue (i.e. the "A") and another illuminating image layer may contain all aspects of the illuminating sections that are red (i.e. the "B"). For example, the illuminating image layer for the "A" may be printed using a first screen and the illuminating image layer for the "B" may be printed using a second screen. Alternately, the same screen may be used to print both the "A" and the "B". A method for dividing an image into illuminating and non-illuminating image layers that may be implemented by the image processor 120 is described in detail in relation to FIG. 5. In accordance with this aspect, the image processor 120 is also configured to generate voltage mapping information from the image file 115 to be used by the voltage mapping module 125. The voltage mapping module may determine the size of the illuminating section and calculate a required voltage based on the size of the section and a desired level of illumination (e.g., the voltage data).

The voltage mapping module 125 is coupled to the image processor 120 and the display 180, and may use the voltage mapping information generated by the image processor 120 to generate timing configuration data, which defines the timing of the illumination of the electroluminescent sign 1 0. A method of generating timing configuration data is described in relation to FIG. 8. From the timing configuration data the voltage mapping module 125 generates a sequence of commands to control the illumination of the electroluminescent sign 10. Voltage mapping module 125 may contain data to alternately, or in addition, control the level of illumination and/or the sequence of illumination of different illuminating sections 18, 20.

The electroluminescent lamp generator 165 may be an amalgamation of individual components that together generate an electroluminescent lamp 12. The electroluminescent lamp generator 165 receives the data on the illuminating and optional non-illuminating image layers from the image processor 120 and generates an electroluminescent lamp 12 having the required image. In the embodiment shown in FIG. 3, the illuminating image layers of the required image may be printed on substrate 30 by known silk-screening techniques to generate an electroluminescent lamp 12. However, other suitable methods, e.g. ink jet printing, vapour deposition, lamination of a separately prepared layer, of depositing the illuminating image layers on the substrate 30 may also be used.

In the silk-screening embodiment shown in FIG. 3, the electroluminescent lamp generator 165 includes a screen maker 130, a silk-screen machine 140, a shift repair module 145 and a lamination module 170. The screen maker 130 comprises equipment that is automatically or manually operable to generate a screen, such as a silk-screening screen. The screen maker 130 receives the image data for the illuminating image layers generated by the image processor 120 and in accordance with standard silk-screening techniques, generates one screen for each layer. Any other method known in the art for producing a plurality of areas of electroluminescent material on a support surface may be sued.

The screen maker 130 may receive the image data for the illuminating image layers from the image processor 120 over a data network, such as an Ethernet network, a wireless network or a combination of the two. Alternatively the screen maker 130 may receive the image data for the illuminating image layers via a transportable storage medium readable by the screen maker 130 such as a portable memory stick, diskette or CD. The mesh size of each screen may be based on the ink being used for that layer, including its mess size, as is known in the screen printing art. The ink used for each layer may be specified by the image processor 120.

The silk-screen machine 140 comprises equipment that is automatically or manually operable to generate an electroluminescent lamp 12 using silk screening techniques. Any silk-screen machine 140 may be used. The silk-screen machine 140 receives the screens created by the screen maker 130 and the substrate 30 that is to be used at the base of the electroluminescent lamp 12.

After receiving the screens and the substrate 30, which may be precoated with front electrode layer 32 if front electrode layer 32 is not applied by silk screen machine 140, the silk-screen machine 140 applies layers of ink to the substrate 30 using the screens. In accordance with the embodiment of FIG. 3, all illuminating layers are printed using a silk-screen machine 140. In one embodiment there are four types of ink applied to the substrate—phosphor ink, insulation or dielectric ink, and conductive ink. The phosphor ink contains the electroluminescent material and is used to create the electroluminescent layer 34 of the electroluminescent lamp 12. As described above, several layers of phosphor ink may be applied to the substrate 30. For example, all illuminating sections of a particular colour may be applied in using a single screen and may be considered a single layer, albeit a discontinuous layer. The insulation or dielectric ink is an electrically insulating material that provides a barrier to the flow of electrons and used to form the dielectric layer 36. The conductive ink can comprise silver, gold or graphite-based ink that is electrically conductive. In another embodiment encapsulate ink may be applied to provide a water barrier that protects the phosphor ink from moisture in the atmosphere.

After each layer of ink is applied to the substrate 30, the substrate 30 may be heated at a specified temperature for a specified time to drive off the ink's solvent. It will be appreciated that the substrate may be heated after two or more non-overlapping layers are applied. The substrate 30 may be heated in an oven or other suitable heating device. The specified temperature may be 130 degrees Celsius, for example, and the specified time may be 20 minutes, for example. Any desired temperature may be used provided it is sufficiently high to drive off the solvent but sufficiently low so as not to degrade the ink of the substrate.

The optional shift repair module 145 is a device or collection of devices that align, e.g., the original non-illuminating image layer with the illuminating image layers printed on the substrate 30. The shift repair module 145 receives the electroluminescent lamp 12 generated by the silk-screen machine 140 and the illuminating and optional non-illuminating image layers generated by the image processor 120. The shift repair module 145 may receive the illuminating and non-illuminating image layers from the image processor 120 over a data network, such as an Ethernet network, a wireless network or a combination of the two. Alternatively the shift repair module 145 may receive the illuminating and non-illuminating image layers via a transportable storage medium readable by the shift repair module 145 such as a portable memory stick, diskette or compact disc (CD).

If the non-illuminating image layer 42 is not printed onto substrate 30, then shift repair module 145 is optionally used to align the non-illuminating image layer 42 with the illuminating image layers printed on substrate 30. This alignment is desirable (although not necessarily required) where heating the substrate during the silk-screening process causes distortions in the substrate 30, which distorts the printed illuminating image layers. This distortion problem can be rectified by using water-based inks. However, this solution cannot be used for a phosphor ink due to its sensitivity to water. Accordingly, to be able to correctly align the non-illuminating image layer with the printed illuminating image layers, the non-illuminating image layer must be similarly distorted. A method for aligning an original non-illuminating image layer with the corresponding printed illuminating image layers that may be implemented by the shift repair module 145 is described below with reference to FIG. 7.

In one embodiment, the shift repair module 145 includes a scanner and a processor. The scanner generates a digital image representing the illuminating image layers printed on the substrate 30. Any scanner known in the art may be used. The digital image is then transferred to the processor. The digital image may be transferred from the scanner to the processor through a data network, such as an Ethernet or wireless network, or through use of removable storage media, such as a memory key, that is written to by the scanner and read by the processor. The processor then compares the digital image with the original illuminating image layer (e.g. image file 115) to determine the distortion. Once the distortion is determined, the processor applies the distortion to the data representing the non-illuminating image layer so that it is aligned with the digital image. A suitably distorted non-illuminating image layer may then be printed on a second transparent or translucent substrate, e.g. by silkscreen machine 140, so as to be laminated on to substrate 30 or printed directly on front surface 31 of substrate 30. The distorted non-illuminating image layer may be printed using any printing device known in the printing arts.

The lamination module 170 is a device or a collection of devices that apply the original non-illuminating image layer or the distorted non-illuminating image layer to front surface 31 of substrate 30. The lamination module 170 receives the electroluminescent lamp 12 generated by the silk-screen machine 140 and preferably the distorted non-illuminating image layer generated using data from the shift repair module 145. After receiving the electroluminescent lamp 12 and a non-illuminating image layer, the lamination module 170 applies the printed image to the electroluminescent lamp 12 through a lamination process.

The electroluminescent lamp 12 is then operably associated with a luminescence controller 14, for example by electrical and physical attachment, connection, or coupling, which is preferably releasable, to form an electroluminescent sign 10. The luminescence controller 14 supplies voltages to parts of the electroluminescent lamp 12 to cause those parts to phosphoresce and thereby illuminate the illuminating portions of the electroluminescent lamp 12. The illuminating portions of the electroluminescent lamp 12 may be illuminated according to a predetermined timing and location pattern, which is set by the sequence of commands generated by the voltage mapping module 125.

It will be appreciated that luminescence controller 14 and electroluminescent lamp 12 may each be separately mounted to a suitable frame and electrically connected together by electrical conduits in the frame. For example, the frame may have a plurality of ports that are contacted by electrodes in layer 38 and by the leads of a controller 14. Alternately, electrodes in layer 38 may be directly connected to controller 14.

Figure 9:
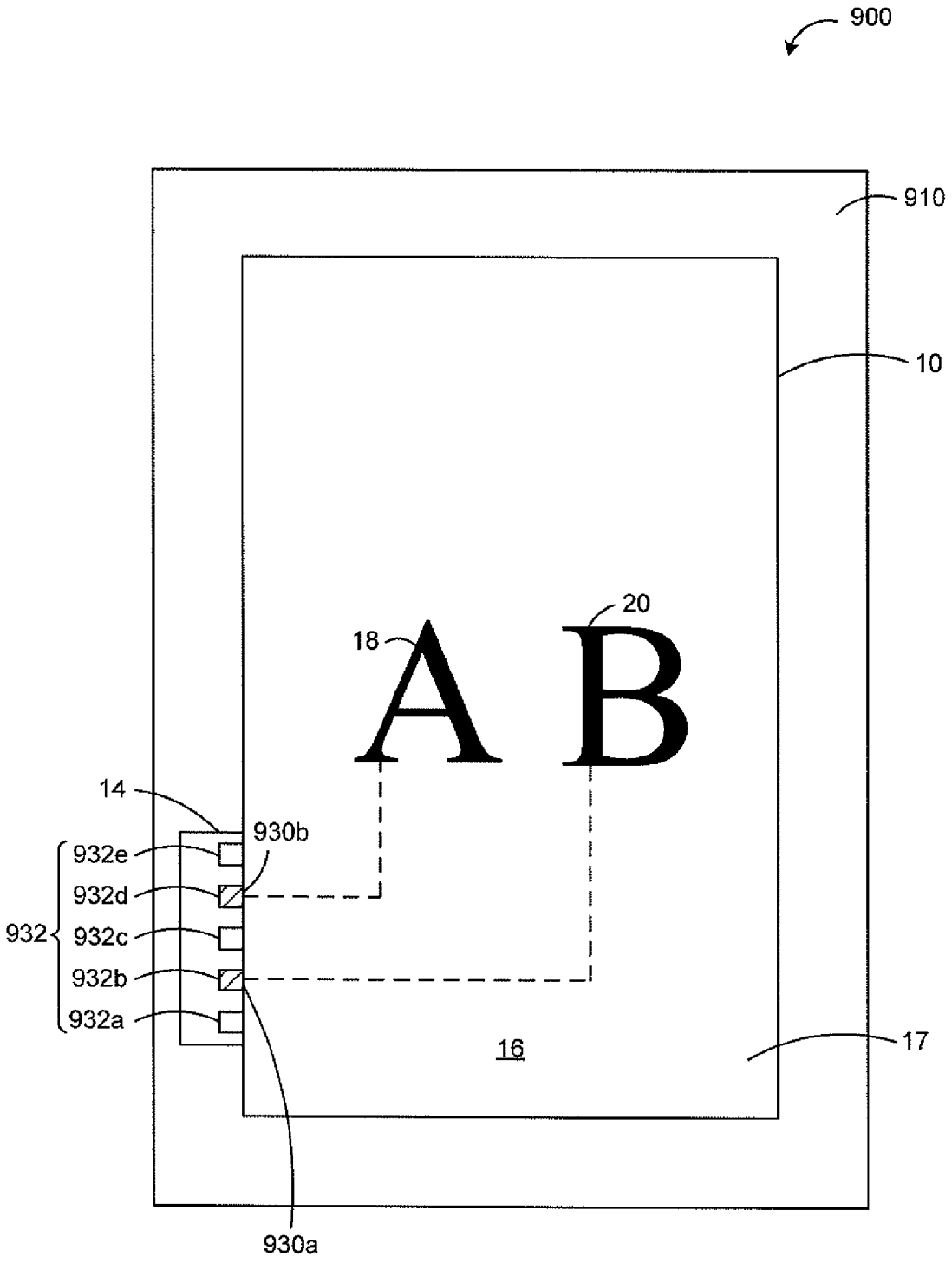
FIG. 9 illustrates an electroluminescent sign system in accordance with an Example embodiment.

For example, FIG. 9, exemplifies an electroluminescent sign system 900 that includes an electroluminescent sign 10 which is mounted in a frame or a mount 910. As discussed with respect to the embodiment of FIG.1, electroluminescent sign 10 includes the image 16 which comprises a number of illuminating sections, such as 18 and 20. Also, the background 17 on which the illuminating sections 18,20 are provided may be a non-illuminating section. The background 17, therefore, may be visible even if not illuminated.

Frame 910 may be used for mounting the electroluminescent sign 10. The frame 910 may comprise a controller, such as the electroluminescent controller 14 which has a plurality of ports (e.g., 5 ports mating ports 923*a*, 932*b*, 932*c*, 932*d* and 932*e* as exemplified in FIG. 9). The electroluminescent controller 14 may be programmable or replaceable, and is preferably programmable, such that it may control the illumination (e.g., intensity, duration and/or sequence) of at lease some, and preferably all, of the illuminating sections 18,20 of the electroluminescent sign 10. The electroluminescent controller 14 may control the illumination by transmitting different amounts of voltage, or electrical energy, to illuminate the illuminating sections 18,20.

Electroluminescent sign 10 may be provided with a number of ports (e.g., pins), such as ports 930*a* and 930*b* that are connectable with mating ports 932 of the electroluminescent controller 14. Preferably, the pins 930 of the electroluminescent sign 10 are removably connectable with mating ports of the electroluminescent controller 14. As illustrated in FIG. 9, pins 930*a* and 930*b* of the electroluminescent sign 10 are connectable with the respective mating ports 932*b* and 932*d* of the electroluminescent controller 14. It will be appreciated that ports 930*a* and 930*b* of the electroluminescent sign 10 may be similarly be connected to any other available mating ports 932 of the electroluminescent controller 14 as long as the electroluminescent controller 14 is programmed accordingly. It will be understood that each port 930 and each mating port 932 may comprise a pin or a port for receiving a pin. For example, as illustrated in FIG. 9, the port 930*a* may comprise a pin and the corresponding mating port 932*b* may comprise a port for receiving the pin.

Since the electroluminescent controller 14 is incorporated into the frame 910, the electroluminescent sign 10 in the frame 910 may be easily replaced with a new sign by disconnecting any connections between the ports 930 of the electroluminescent sign 10 from the mating ports 932 of the electroluminescent controller 14 and removing the electroluminescent sign 10 from the frame or mount 910. A new sign may then be mounted on the existing mount 910 or placed in or on the existing frame 910. The ports of the new sign can then be connected or plugged into the mating ports 932 of the electroluminescent controller 14. The sign may have a different number of ports 930 from the electroluminescent sign 10.

Figure 10:
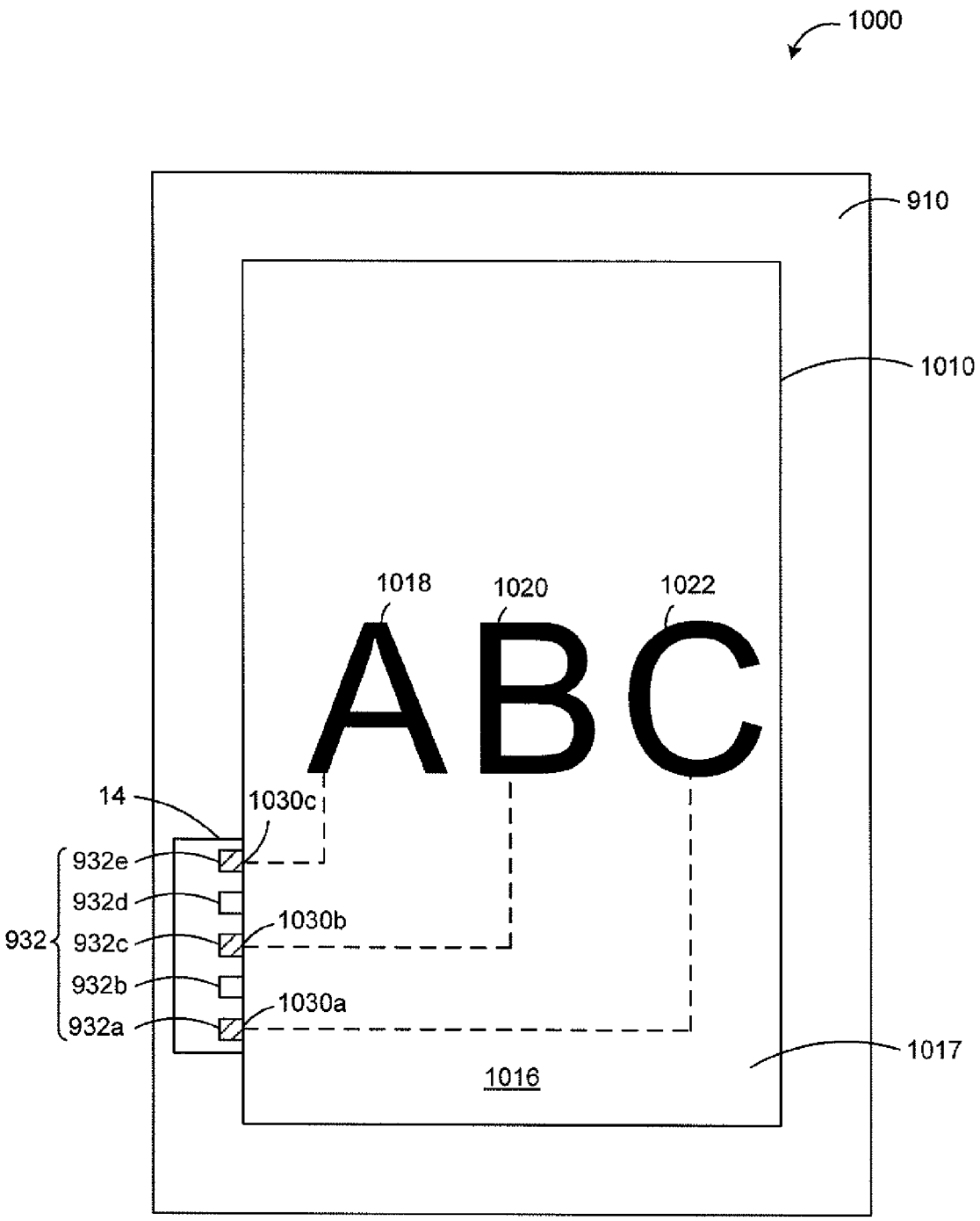
FIG. 10 illustrates an electroluminescent sign system in accordance with another example embodiment.

For example, referring now to FIG. 10 new includes image 1016 which includes illuminating sections 1018, 1020 and 1022 and a non-illuminating section 1017 on which the illuminating sections 1018, 1020 and 1022 are provided. The new electroluminescent sign 1010 also includes ports 1030*a*, 1030*b* and 1030*c*. As described above, it will be understood that each of the ports 1030a, 1030b and 1030c may comprise a pin or a port for receiving a pin. To mount the new electroluminescent sign 1010 into the frame 910, the ports 1030a, 1030b, 1030c of the second electroluminescent sign 1010 may be connected with the mating ports 932 of the electroluminescent controller 14. As illustrated in FIG. 10, the ports 1030*a*, 1030*b*, 1030*c* of the second electroluminescent sign 1010 are connected with the respective mating ports 932*a*, 932*c* and 932*e* of the electroluminescent controller 14.

In some embodiments, the electroluminescent controller 14 may be replaced with a new electroluminescent controller programmed for the new sign, such as the new electroluminescent sign 1010, or the electroluminescent controller 14 may be programmed for the new sign, such as by downloading a new program into the electroluminescent controller 14.

In some embodiments, the electroluminescent controller 14 may be programmed with different electrical configuration data appropriate for the new sign. For example, the number of illuminating sections of the new sign may be different (larger or smaller) then the previous sign. For example, the second electroluminescent sign 1010 has three different illuminating sections 1018, 1020 and 1022 whereas the electroluminescent sign 10 has two different illuminating sections 18 and 20. Accordingly, the electrical configuration data may contain data for a larger or smaller number of illuminating sections. Alternately, or in addition the size of some or all of the illuminating sections may be sufficiently different to require a differing amount of voltage to achieve a desired level of illumination. Alternately, it may merely be desired to adjust the sequence, intensity, etc. of illumination of an existing sign. Accordingly, the electroluminescent controller 14 may be reprogrammed, such as by any means known in the art, so that the electroluminescent controller 14 is configured to control the new sign.

Figure 4:
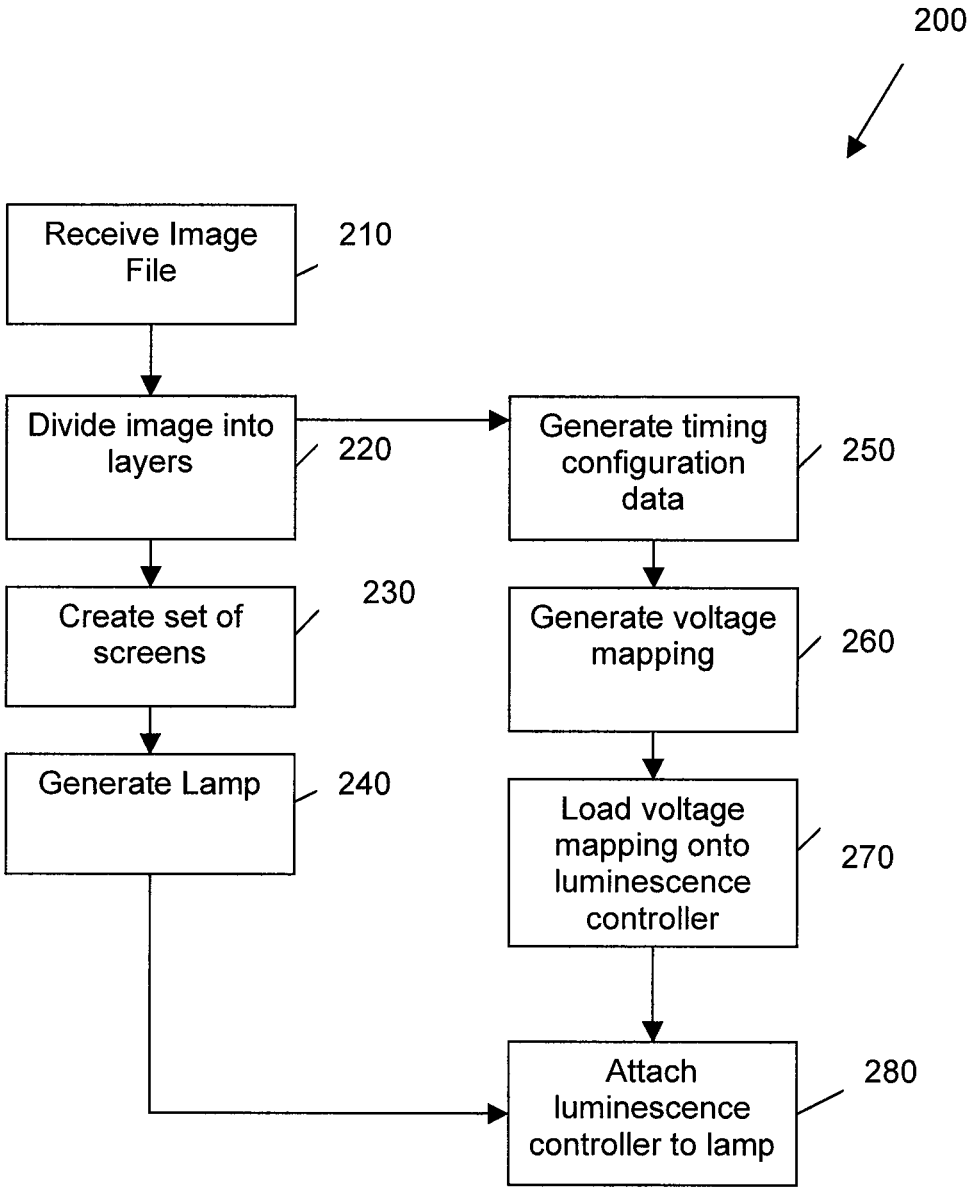
FIG. 4 is a flowchart of a method of developing an electroluminescent sign.

Reference is now made to FIG. 4, in which a flowchart of a method of developing an electroluminescent sign 10 using system 100 is exemplified. In the first step 210 an image file 115 is received. As stated above, the image file 115 may be a vector-based image file that represents the image to be displayed on the electroluminescent sign 10. The image file 115 is typically loaded into the workstation 110 and stored in the workstation memory 135. Once the image file has been received, at step 220 the image file 115 is divided into illuminating and optional non-illuminating image layers. A method for dividing an image file 115 into illuminating and non-illuminating image layers is described below with reference to FIG. 5. During this step 220, the image processor 120 also generates voltage mapping information from the image file 115 to be used by the voltage mapping module 135.

Once the image file 115 has been divided into illuminating and non-illuminating image layers, at step 230 screens to be used in a silk-screening process are generated for each illuminating image layer, and optionally for the non-illuminating layers. In system 100, the silk-screens are generated by the silk-screen maker 130. Specifically, the silk-screen maker 130 receives the illuminating art file generated by the image processor 120 and one screen is generated for each layer of the illuminating art file.

After the screens have been generated in step 230, in step 240 the electroluminescent lamp 12 is generated. In one embodiment the electroluminescent lamp 12 is generated from the screens using well-known silk-screening techniques. A method for generating a sign using silk-screening techniques is described below with reference to FIG. 6.

In addition to generating a set of screens for the silk-screening process, the information generated in step 220 is also used in step 250 by the voltage mapping module 125 to generate, e.g., timing, sequence and/or voltage data. The timing data defines the timing of the illumination of the illuminating sections of the electroluminescent lamp 12. The voltage data defines the intensity of the illumination of the illuminating sections of the electroluminescent lamp 12 and comprises voltages values representing voltages transmitted to an illuminating section 18, 20. The sequence data defines the sequence of the illumination of the illuminating sections of the electroluminescent lamp 12. Accordingly, this configuration data may set out which illuminating sections of the electroluminescent lamp 12 will be illuminated when, for how long and at what brightness. For example, if the image 16 has two illuminating sections 18, 20 as shown in FIG. 1, the timing configuration data may specify at specific points in time which of the illuminating sections are illuminated and at what intensity. A method for generating configuration data that may be implemented by the voltage mapping module 125 is described below with reference to FIG. 8.

Once the configuration data has been generated, in step 260 the voltage mapping module 125 converts the configuration data into a sequence of commands to control the illumination of the electroluminescent lamp 12. In one embodiment the sequence of commands comprise a sequence of voltage levels for each illuminating section of the electroluminescent lamp 12. In one embodiment the voltage levels are automatically generated by the voltage mapping module 125 based on the size of the illuminating sections. A higher voltage level will be required to illuminate to the same brightness an illuminating section with a greater area than one with a smaller area.

After the sequence of commands is generated in step 260, at step 270 the commands are loaded onto the luminescence controller 14. Once the commands are loaded onto the luminescence controller 14, the electroluminescent lamp 12 is physically and electrically attached, coupled or connected, at step 280, to the luminescence controller 14 to form the electroluminescent sign 10. Where the image 16 is comprised of a plurality of illuminating sections (i.e. 18, 20), each illuminating section of the electroluminescent lamp 12 is separately attached, coupled or connected to the luminescence controller 14.

Figure 5:
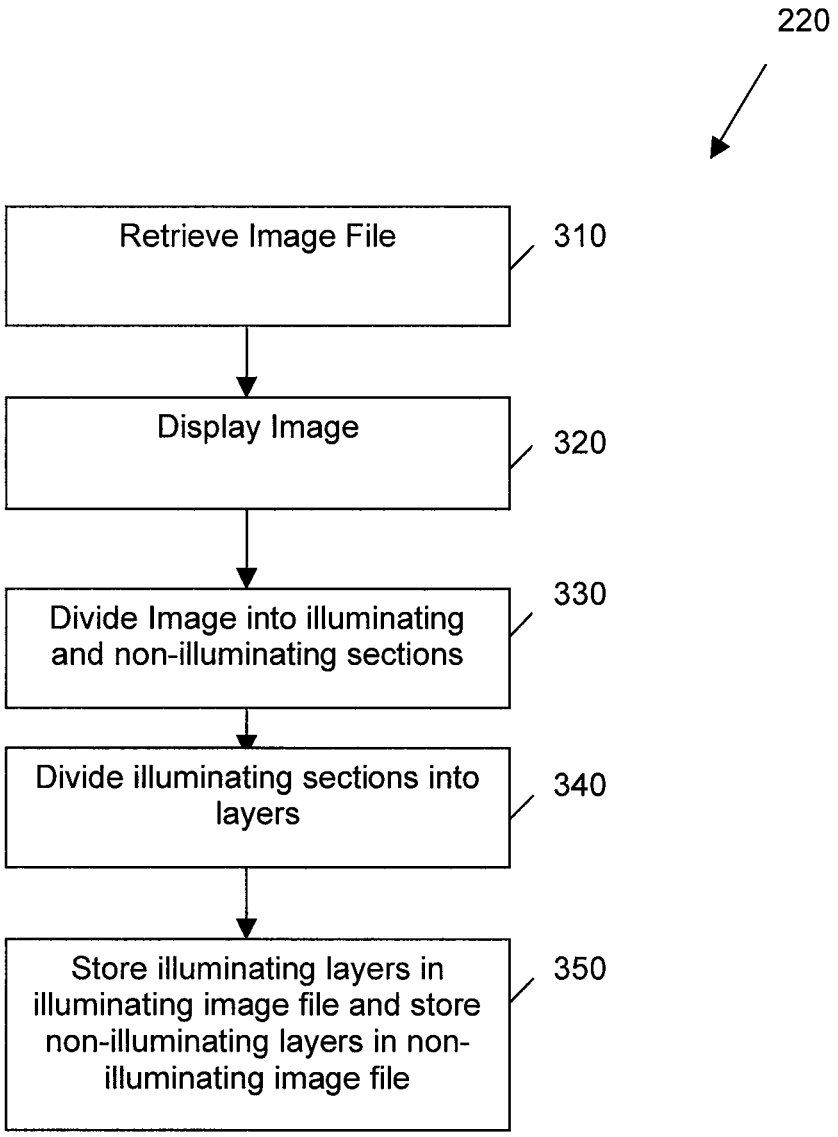
FIG. 5 is a flowchart of a method of dividing an image into illuminating and non-illuminating layers.

Reference is now made to FIG. 5, in which a flowchart of a method 220 for dividing an image into illuminating and non-illuminating layers is exemplified. In the first step 310 the image processor 120 retrieves the image file 115 from the memory 135.

After the image file 115 is retrieved, at step 320 the image processor 120 displays the image contained in the image file 115 on the display 180.

Then, at step 330 the image is divided into illuminating sections and optional non-illuminating sections. Typically an operator will identify which sections of the image are to be illuminated and may determine which parts are to be separate illuminating sections. For example, the operator may be provided tools for selecting sections of the image shown on the display 180 and identifying them as being illuminating sections. Those sections of the image that are not identified as illuminating section may form the non-illuminating image layer. As was described above in relation system 100, the non-illuminating image layer may be applied (i.e. laminated) to the electroluminescent lamp 12 in the last step of the process.

Then, at step 340 the image processor 120 divides the illuminating sections of the image into image data representing at least one image layer. In one embodiment the illuminating sections of the image are divided into layers based on color. For example, all red areas of the illuminating sections may be placed in one illuminating image layer and all blue areas of the illuminating sections may be placed in another illuminating image layer. In this embodiment, the number of illuminating layers will be based on the number of different colors in the illuminating sections of the image. The layers are then subsequently used to create the screens for the silk-screening processing. For example, the red illuminating image layer will be used to create the screen to be used for the red ink and the blue illuminating image layer will be used to create a screen to be used to apply the blue ink. It will be appreciated that a plurality of illuminating sections of the same colour may also be produced.

Finally, at step 350 the image processor 120 stores the image data in an art file referred to as the illuminating art file and stores the non-illuminating image layers in an art file referred to as the non-illuminating art file. These files (e.g., PS, EPS, giff, tiff, jpg, png, psd) are used to produce the screen for the silk screening process In addition to generating the illuminating and non-illuminating art files, the image processor 120 may also the voltage mapping art file.

Figure 6:
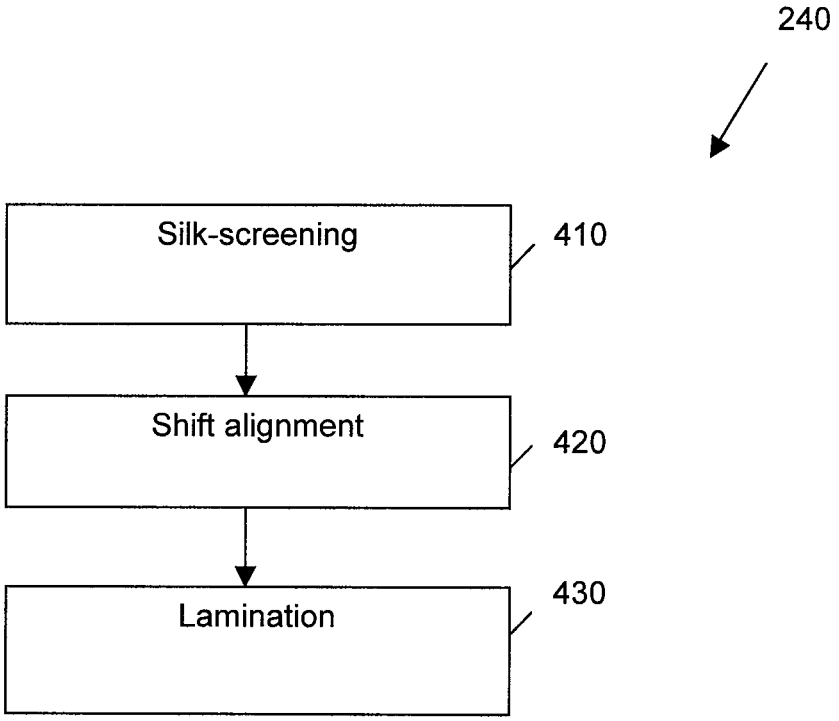
FIG. 6 is a flowchart of a method of generating an electroluminescent lamp using silk-screening techniques.

Reference is now made to FIG. 6, in which a method 240 for generating an electroluminescent lamp 12 using silk-screening techniques is exemplified. The method 240 preferably involves three steps—the silk-screening step 410, the shift alignment step 420 and the lamination step 430.

In the silk-screening step 410, the silk-screen machine 140 prints the illuminating image layers on the substrate 30. Specifically, the silk-screen machine 140 uses the screens generated by the screen maker 130 in step 230 of method 200 to apply layers of ink to the substrate 30. As noted above, after each layer of ink is applied to the substrate 30, the substrate 30 may be heated to remove the liquid component of the ink.

In the optional shift alignment step 420, the shift repair module 145 aligns the original non-illuminating image layer with the illuminating image layers printed on the substrate 30. As noted above, this step is advantageous where heating the substrate 30 distorts the substrate 30, which accordingly distorts the illuminating image layers printed on the substrate 30. A preferred method for aligning the printed illuminating image layers with the original non-illuminating image layer is described below with reference to FIG. 7. Essentially, the exemplified shift repair module 145 compares the printed illuminating image layers to the original illuminating image layers to determine the distortion, and then applies the same distortion to the non-illuminating image layer to generate a distorted non-illuminating image layer.

Once a distorted non-illuminating image layer has been generated, in the laminating step 430, the distorted non-illuminating image layer is applied to the inked substrate (i.e. lamp) by the lamination module 170. In one embodiment the lamination module 170 prints the distorted non-illuminating image layer using an ink-jet printer or other similar device and laminates it to the electroluminescent lamp 12. In another embodiment, a printed non-illuminating layer 42 is applied to outer surface 31 of substrate 30.

Figure 7:
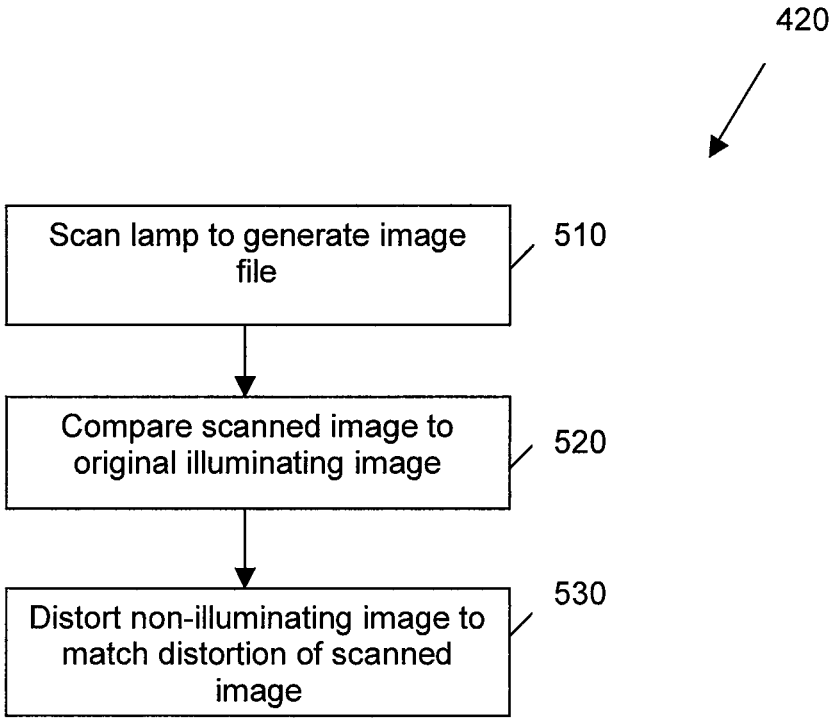
FIG. 7 is a flowchart of a method to align printed illuminating image layers with a corresponding non-illuminating image layer.

Reference is now made to FIG. 7, in which a method 420 for aligning printed illuminating image layers with a corresponding non-illuminating image layer is exemplified. At step 510 the electroluminescent lamp 12 is scanned to generate an electronic image of the illuminating image layers printed on the substrate 30. The scanning may be accomplished with a blueprint scanner or other similar scanning devices.

At step 520, the electronic image of the illuminating image layers printed on the substrate 30 is compared to the illuminating image layers in the original illuminating art file, e.g., an image file produced by image processor 120, to determine the distortion pattern (also referred to as a shift pattern).

Once the distortion or shift pattern is determined, at step 530 the original non-illuminating image layer is similarly distorted and saved in a new non-illuminating art file.

Figure 8:
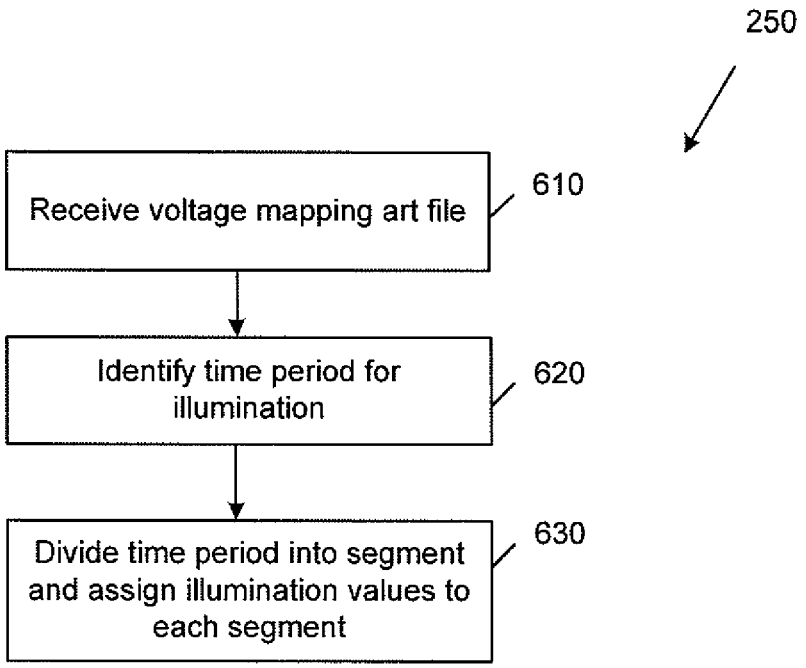
FIG. 8 is a flowchart of a method to generate timing configuration data to control the illumination of an electroluminescent lamp.

Reference is now made to FIG. 8, in which a method 250 for generating configuration data is exemplified. As previously mentioned, the configuration data may set out which illuminating sections of the image will be illuminated when, for how long and at what brightness. In the first step 610 of method 250 the voltage mapping module 125 receives the voltage mapping art file from the image processor and displays the corresponding image on the display 180. In one embodiment, the illuminating sections of the image are identified on the display 180 and distinguished from the non-illuminating sections.

In step 620 the operator identifies, e.g., the length of time the illumination sequence will run. For example, the user may want an illumination sequence to run for 30 seconds and then repeat. The length of time the illumination sequence will run will be referred to as the illumination time period.

After the illumination time period is determined, at step 630 the illumination period is divided into a number of equal or unequal time segments. The number and size of the time segments may be automatically selected by the voltage mapping module 125 or may be manually selected by the operator. Once the time segments have been defined, the operator assigns an illumination intensity value to each time segment for each illuminating section (i.e. 18, 20) of the image 16. The higher the illumination intensity value, the brighter the illumination. In one embodiment an illumination intensity value of zero indicates that the associated illuminating section is "off" or not illuminated.

Once the operator has entered illumination intensity values for each illuminating section of the image, the voltage mapping module 125 preferably generates a simulation of electroluminescent sign 10 using the selected illumination intensity values. The simulation is then shown to the operator on the display 180. The operator can then determine if they are satisfied with the operation of the electroluminescent sign 10 using the selected illumination intensity value. If the operator is not satisfied, then the operator may be given the option to edit the illumination intensity setting and then run another simulation. If the operator is satisfied with the simulation, then the illumination intensity values are converted to a sequence of commands to control the illumination of the illumination sections of the electroluminescent lamp 12.

It will be appreciated that the intensity values may be determined regardless of whether timing data is produced. Further, in any embodiment, the voltage mapping module 125 may automatically produce the voltage configuration data.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the spirit and scope of the described embodiments.

The invention claimed is:

1. A method of developing an electroluminescent sign based on an image file, comprising:

(a) electronically processing the image file to generate image data representing at least one electroluminescent lamp and corresponding electrical configuration data, the electroluminescent lamp comprising a substrate, a front electrode layer, at least one illuminating image layer and a rear electrode layer, wherein the front electrode layer is applied to an inner face of the substrate, wherein the at least one illuminating image layer is formed on a rear face of the front electrode layer and forms one or more images to be illuminated, and wherein the rear electrode layer is formed on a rear face of the at least one illuminating image layer;

(b) producing the at least one illuminating image layer on the front electrode layer of the electroluminescent lamp from the image data; and, (c) configuring a luminescence controller of the electroluminescent sign based on the electrical configuration data, wherein, in use, the configured luminescence controller controls voltage supply to the at least one illuminating image layer.

2. The method of claim 1, wherein the image file represents at least one image, and electronically processing the image file to generate image data comprises:

(a) dividing the at least one image into a plurality of illuminating sections, which are to be provided in the at least one illuminating image layer; and, (b) generating illuminating image data representing each illuminating section.

3. The method of claim 2, wherein electronically processing the image file to generate image data further comprises, also dividing the at least one image into at least one non-illuminating section and generating non-illuminating image data representing the at least one non-illuminating section of the at least one image.

4. The method of claim 3, further comprising, producing the at least one non-illuminating section of the at least one image on the substrate using the non-illuminating image data.

5. The method of claim 1, wherein the at least one illuminating image layer has at least one illuminating section, wherein the electroluminescent lamp further comprises a non-illuminating image layer printed on the substrate, the non-illuminating image layer comprising at least one non-illuminating image, and the method further comprises aligning the at least one illuminating section with a corresponding portion of the non-illuminating image.

6. The method of claim 1, further comprising dividing the image file into a plurality of illuminating sections and wherein electronically processing the image file to generate electrical configuration data comprises producing voltage data corresponding a degree of illumination for the illuminating sections.

7. The method of claim 1, wherein the at least one illuminating image layer comprises at least one illuminating section and electronically processing the image file to generate electrical configuration data comprises:

(a) selecting an illumination time period;

(b) dividing the illumination period into a plurality of time segments;

(c) assigning an illumination intensity value to each of the plurality of time segments; and, (d) generating timing data for configuring timing of illumination of one or more illuminating sections using the illumination intensity values.

8. The method of claim 7, wherein electronically processing the image file to generate electrical configuration data further comprises generating a sequence of commands using the timing data, wherein the sequence of commands controls the voltage supply to the at least one illuminating section.

9. The method of claim 8, wherein the sequence of commands include voltages values representing the voltage supply to the at least one illuminating section.

10. The method of claim 9, wherein the voltage values are generated based on the timing configuration data and dimensions of the at least one illuminating section.

11. The method of claim 1, wherein the at least one illuminating image layer comprises a plurality of illuminating sections, and the electrical configuration data comprises timing data for configuring timing of illumination of one or more of the illuminating sections.

12. The method of claim 1, wherein the at least one illuminating image layer comprises a plurality of illuminating sections, and the electrical configuration data comprises timing data for configuring timing of illumination of the plurality of illuminating sections.

13. The method of claim 1, wherein producing the at least one illuminating image layer on the front electrode layer includes using a screening process.

14. The method of claim 13, further comprising generating at least one screen for the at least one illuminating image layer using the image data.

15. The method of claim 14, wherein producing the at least one illuminating image layer on the front electrode layer includes applying a first ink layer corresponding to the front electrode layer and a second ink layer corresponding to the at least one illuminating image layer to the substrate using corresponding screens.

16. The method of claim 1, wherein the luminescence controller is programmable and the method further comprises inputting the electrical configuration data into the luminescence controller.

17. The method of claim 1, wherein when the voltage is applied across the front electrode layer and the rear electrode layer, the at least one electroluminescent layer is activated.

18. The method of claim 1, wherein the electroluminescent lamp further comprises a dielectric layer between the at least one illuminating image layer and the rear electrode layer, the dielectric layer comprising an electrically insulating material.

19. The method of claim 1, wherein the front electrode layer comprises an electrically conductive material.

20. The method of claim 1, wherein the at least one illuminating image layer comprises phosphor.

21. A system for developing an electroluminescent sign, comprising:

at least one processor; and data storage accessible to the at least one processor and storing program instructions which, when executed by the at least one processor, cause the at least one processor to process an image file to generate image data that represents at least one electroluminescent lamp and corresponding electrical configuration data, wherein the electroluminescent lamp comprising a substrate, a front electrode layer, at least one illuminating image layer and a rear electrode layer, wherein the front electrode layer is applied to an inner face of the substrate, wherein the at least one illuminating image layer is formed on a rear face of the front electrode layer and forms one or more images to be illuminated, and wherein the rear electrode layer is formed on a rear face of the at least one illuminating image layer, and wherein the image data is for producing the at least one illuminating image layer on the front electrode layer of the electroluminescent lamp and wherein the electrical configuration data is for configuring a luminescence controller of the electroluminescent sign wherein, in use, the configured luminescence controller controls voltage supply to the at least one illuminating image layer.

22. The system of claim 21, wherein the electrical configuration data comprises timing data for configuring timing of illumination of one or more illuminating sections of the at least one illuminating image layer.

23. The system of claim 21, wherein the electroluminescent sign comprises a plurality of illuminating sections and the electrical configuration data comprises voltage data corresponding a degree of illumination for the plurality of illuminating sections.

24. An electroluminescent sign produced by the process comprising:

(a) receiving an image file;

(b) processing the image file to generate image data representing at least one electroluminescent lamp and corresponding electrical configuration data, wherein the electroluminescent lamp comprising a substrate, a front electrode layer, at least one illuminating image layer and a rear electrode layer, wherein the front electrode layer is applied to an inner face of the substrate, wherein the at least one illuminating image layer is formed on a rear face of the front electrode layer and forms one or more images to be illuminated, and wherein the rear electrode layer is formed on a rear face of the at least one illuminating image layer;

(c) producing the at least one illuminating image layer on the front electrode layer of the electroluminescent lamp using the image data; and, (d) configuring a luminescence controller of the electroluminescent sign based on the electrical configuration data, wherein, in use, the configured luminescence controller controls voltage supply to the at least one illuminating image layer.

* * * * *